US006064836A

United States Patent [19]

Nakamura et al.

[11] Patent Number: 6,064,836

[45] Date of Patent: May 16, 2000

[54] IMAGE FORMATION SUPERVISORY SYSTEM AND METHOD FOR CONTROLLING THE NUMBER OF TIMES AN IMAGE IS FORMED UNDER EACH IDENTIFICATION CODE

[75] Inventors: Hidenobu Nakamura; Tomokazu Kato, both of Toyokawa; Hiroyuki Asai, Okazaki; Tomoyuki Atsumi, Toyohashi, all of Japan

[73] Assignee: Minolta Co., Ltd., Osaka, Japan

[21] Appl. No.: 08/890,620

[22] Filed: Jul. 9, 1997

[30] Foreign Application Priority Data

Jul. 16, 1996 [JP] Japan ..... 8-185823

[51] Int. Cl.[7] ..... G03G 15/00

[52] U.S. Cl. ..... 399/8; 399/43; 399/79; 399/80; 377/16; 377/28

[58] Field of Search ..... 395/187.01; 399/366, 399/10, 12, 79, 80, 81, 43, 8; 377/13, 14, 15, 16, 28; 355/112; 235/375

[56] References Cited

U.S. PATENT DOCUMENTS

| | | | |
|---|---|---|---|
| 4,811,053 | 3/1989 | Ito et al. | 355/14 |
| 4,992,827 | 2/1991 | Kobayashi et al. | 355/202 |
| 5,016,059 | 5/1991 | Smeiman | 355/308 |
| 5,066,977 | 11/1991 | Yoshizuka | 355/201 |
| 5,300,761 | 4/1994 | Kasahara et al. | 235/375 |
| 5,384,622 | 1/1995 | Hirata et al. | 355/206 |
| 5,485,245 | 1/1996 | Kobayashi et al. | 355/202 |
| 5,784,664 | 7/1998 | Nakamura et al. | 399/8 |
| 5,802,423 | 9/1998 | Okunishi | 399/80 |

FOREIGN PATENT DOCUMENTS

| | | | |
|---|---|---|---|
| 59-91569 | 5/1984 | Japan | G06F 15/20 |
| 59091569 | 5/1984 | Japan | G06F 15/20 |
| 61-32862 | 2/1986 | Japan | G03G 15/00 |
| 61032862 | 2/1986 | Japan | G03G 15/00 |
| 03255466 | 11/1991 | Japan | G03G 15/00 |
| 3-255466 | 11/1991 | Japan | G03G 15/00 |
| 04321061 | 11/1992 | Japan | G03G 15/00 |
| 4-321061 | 11/1992 | Japan | G03G 15/00 |
| 05020470 | 1/1993 | Japan | G06F 15/74 |
| 5-20470 | 1/1993 | Japan | G06F 15/74 |

*Primary Examiner*—Robert W. Beausoliel, Jr.
*Assistant Examiner*—Andy Nguyen
*Attorney, Agent, or Firm*—Burns, Doane, Swecker & Mathis, LLP

[57] ABSTRACT

An image forming apparatus supervisory system is provided. The image forming apparatus supervisory system includes an image forming apparatus and a control device. The image forming apparatus has an input unit for inputting an identification code and a transmission unit for transmitting the identification code. The control device is connected to the image forming apparatus, and has a reception unit for receiving the identification code and a transmission unit for transmitting to the image forming apparatus a signal for informing the image forming apparatus of a permitted number of time an image can be formed in response to receipt of the identification code. Upon receipt of the signal from the control device, the image forming apparatus permits forming an image the permitted number of times.

20 Claims, 15 Drawing Sheets

IMAGE FORMATION SUPERVISORY SYSTEM AND METHOD FOR CONTROLLING THE NUMBER OF TIMES AN IMAGE IS FORMED UNDER EACH IDENTIFICATION CODE

BACKGROUND OF THE INVENTION (1) Field of the Invention

The present invention relates to an image formation supervisory control system including an image forming apparatus and a supervisory control unit connected to the image forming apparatus for mutual communication, and to a method for supervising such an image forming apparatus using the supervisory control unit.

(2) Related Art

An image forming apparatus for business use, such as a copying machine and a printer, is often shared by several sections in one firm. In such a case, it is necessary to control the number of copies made by each section for budget planning and other purposes.

In conducting the above control operation, a control apparatus, such as a computer, is connected to one or more image forming apparatuses via a telephone line and the like, so as to transmit various kinds of information between the control apparatus and the image forming apparatuses. In a system shown in FIGS. 1A and 1B, for instance, the upper limit is set to the number of copies each section is allowed to make, while making more than the limit number of copies is prohibited.

In FIGS. 1A and 1B, copying machines 1000A to 1000C and a host computer 2000 are connected via a telephone line 3000. An identification code assigned to one section (hereinafter referred to as "section ID") is registered in each of the copying machines 1000A to 1000C beforehand. A section ID inputted by a user is compared with the registered section ID, and if both section IDs are identical, the inputted section ID is transmitted to the host computer 2000 via the telephone line 3000.

The host computer 2000 monitors the current total number of copies made by each section. When a section ID is received from one of the copying machines 1000A to 1000C via the telephone line 3000 and the current total number of copies made under the section ID is smaller than the upper limit number of copies predetermined for the section ID, the host computer 2000 permits a copying operation to the copying machine into which the section ID has been inputted.

The copying machine, to which the copying operation is allowed, informs the host computer 2000 of the number of copies after the copying operation. The host computer 2000 adds the number of copies to the total number of copies made by the section. If the addition result is larger than the upper limit number, copying will be prohibited under the section ID.

In the conventional copying machine supervisory control system described above, the number of copies made by each copying machine is sent to the host computer after the copying, and added to the total number of copies already stored in the host computer. Since copying under the section ID is permitted until the total number of copies made by the section reaches the upper limit number, the total number of copies made by the section is already larger than the upper limit number when each copying machine is prohibited from copying under the section ID. For this reason, the conventional copying machine supervisory control system fails to strictly control the number of copies made by each section.

In the case where the host computer permits a first copying machine to perform a copying operation under a section ID and receives the same section ID from a second copying machine while the first copying machine is performing the copying operation, the host computer permits the second copying machine to perform a copying operation, because the host computer has not been informed of the number of copies from the first copying machine in this stage, and the total number of copies made by the section has not surpassed the upper limit number.

In such case, the number of copies increases at both copying machines, and when the host computer is informed of the number of copies, the total number of copies surpasses the upper limit number even further, spoiling the setting of the upper limit number to control the number of copies made by each section.

SUMMARY OF THE INVENTION

The first object of the present invention is to provide a supervisory system which restricts the number of times an image is formed by one user using an image forming apparatus within a predetermined upper limit.

The second object of the present invention is to provide a supervisory method for restricting the number of times an image is formed by one user using an image forming apparatus within a predetermined upper limit.

The first object of the present invention can be achieved by providing an image forming apparatus supervisory system comprising an image forming apparatus and a control device. The image forming apparatus has an input unit for inputting an identification code and a transmission unit for transmitting the identification code. The control device is connected to the image forming apparatus, and has a reception unit for receiving the identification code and a transmission unit for transmitting to the image forming apparatus a signal for informing the image forming apparatus of a permitted number of times an image can be formed in response to receipt of the identification code. Upon receipt of the signal from the control device, the image forming apparatus permits forming an image the permitted number of times.

The first object of the present invention can also be achieved by providing an image forming apparatus supervisory system comprising a plurality of image forming apparatuses and a control device. Each image forming apparatus has an input unit for inputting an identification code and a transmission unit for transmitting the identification code. The control device is connected to the plurality of image forming apparatuses, and has a reception unit for receiving the identification code and a transmission unit for transmitting, in response to receipt of the identification code, a signal for informing one of the plurality of image forming apparatuses which has transmitted the identification code of a permitted number of times an image can be formed. Upon receipt of the signal from the control device, the image forming apparatus permits forming an image the permitted number of times.

The second object of the present invention can be achieved by a method for supervising the number of times an image is formed by an image forming apparatus using a system including the image forming apparatus and a control device connected to each other. This method comprises the steps of: (1) inputting an identification code into the image forming apparatus; (2) transmitting the inputted identification code from the image forming apparatus to the control device; (3) transmitting, from the control device to the image forming apparatus, a signal for informing the image forming apparatus of a permitted number of times an image can be formed in response to receipt of the identification code by the control device; and (4) permitting the image forming apparatus to form an image the permitted number of times, upon receipt of the signal by the image forming apparatus.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

The following is an explanation of an embodiment of the present invention. In this embodiment, the number of copies made by each copying machine is monitored for each section in a firm.

(1) Overall Structure of the Copying Machine Supervisory Control System

Figure 1A:
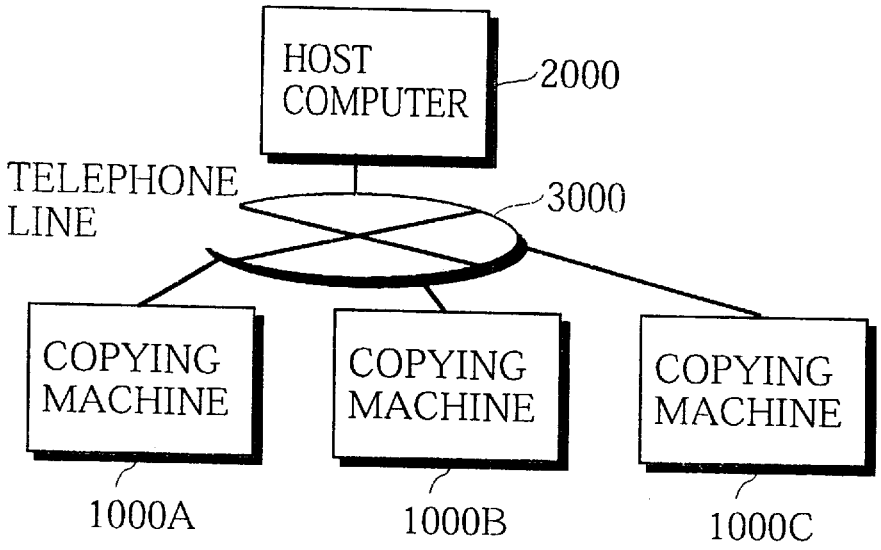
FIG. 1A PRIOR ART
FIGS. 1A and 1B show the structure of a copying machine supervisory control system of the prior art.
Figure 1B:
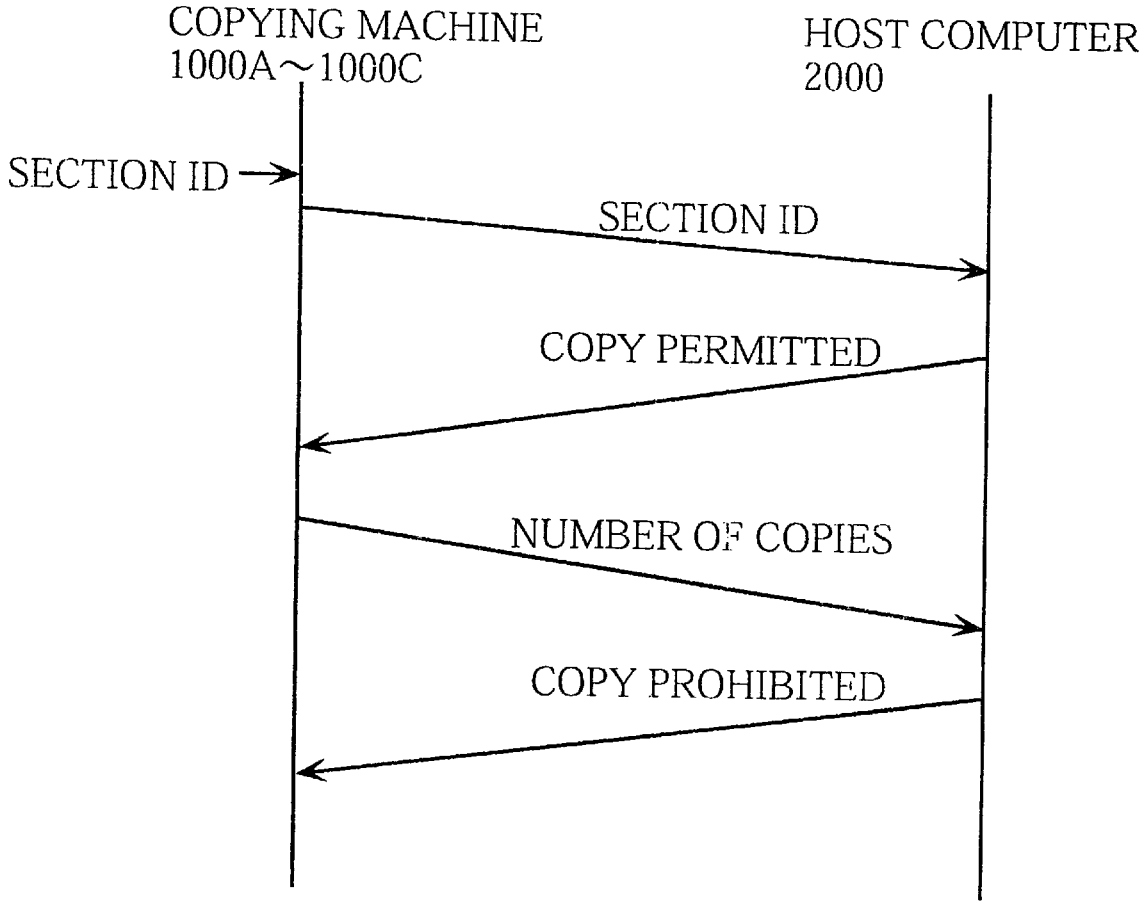
FIG. 1B PRIOR ART
Figure 2:
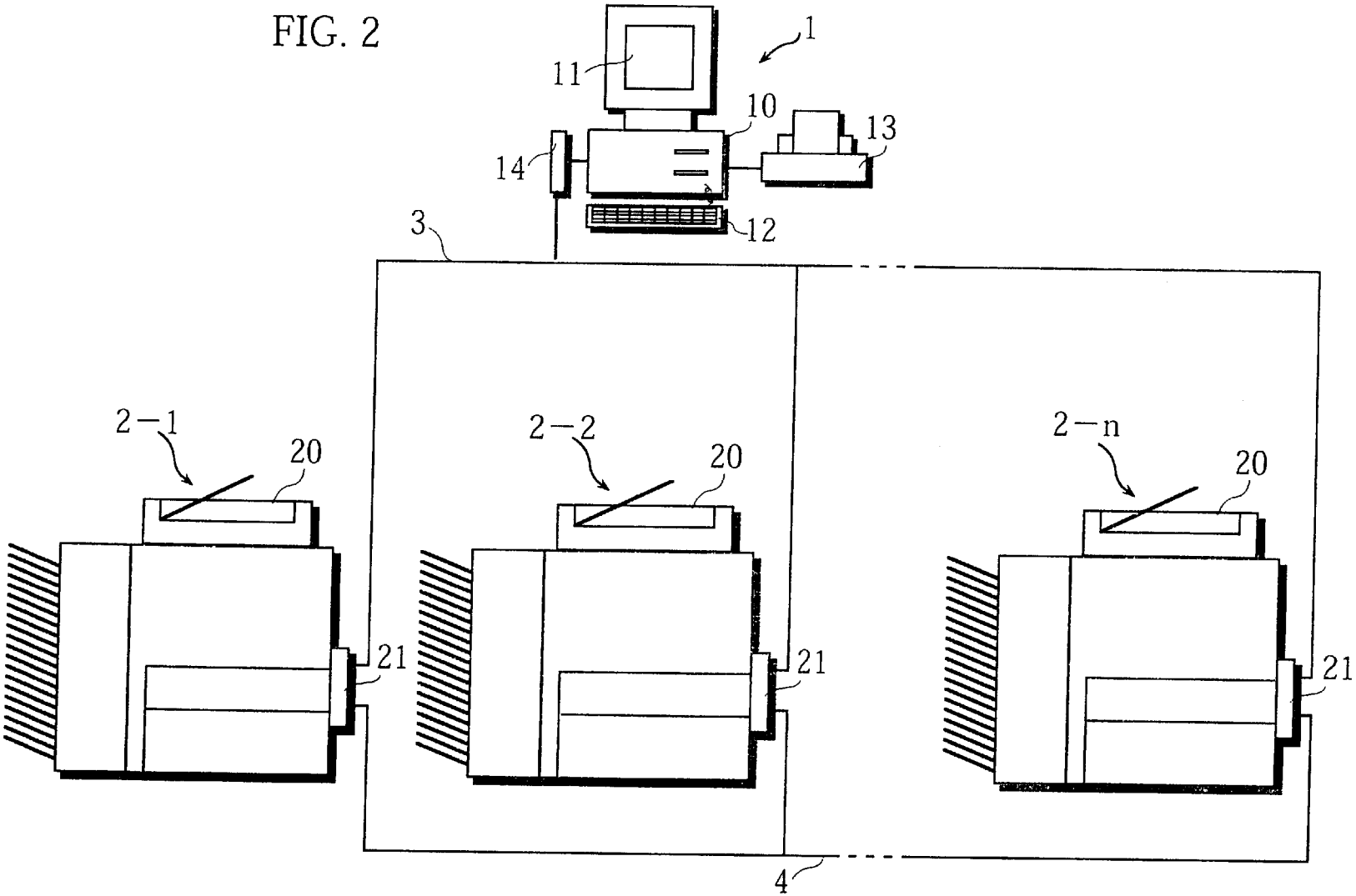
FIG. 2 shows the overall structure of a copying machine supervisory control system of the present invention.

FIG. 2 shows the overall structure of the copying machine supervisory control system of the embodiment.

The copying machine supervisory control system comprises a host computer 1 provided at a service center and a plurality of copying machines 2-1 to 2-n provided on each floor of the building.

The host computer 1 comprises a main body 10, a display 11, a keyboard 12, a printer 13, and a modem unit 14. Each of the copying machines 2-1 to 2-n includes a main body 20 and a modem unit 21. The modem unit 21 of each copying machine is connected to the host computer 1 via a telephone line 3. The copying machines 2-1 to 2-n are connected to each other via a private line 4, so that they can communicate with each other. In the description below, any of the copying machines will be referred to as the copying machine 2.

Figure 3A:
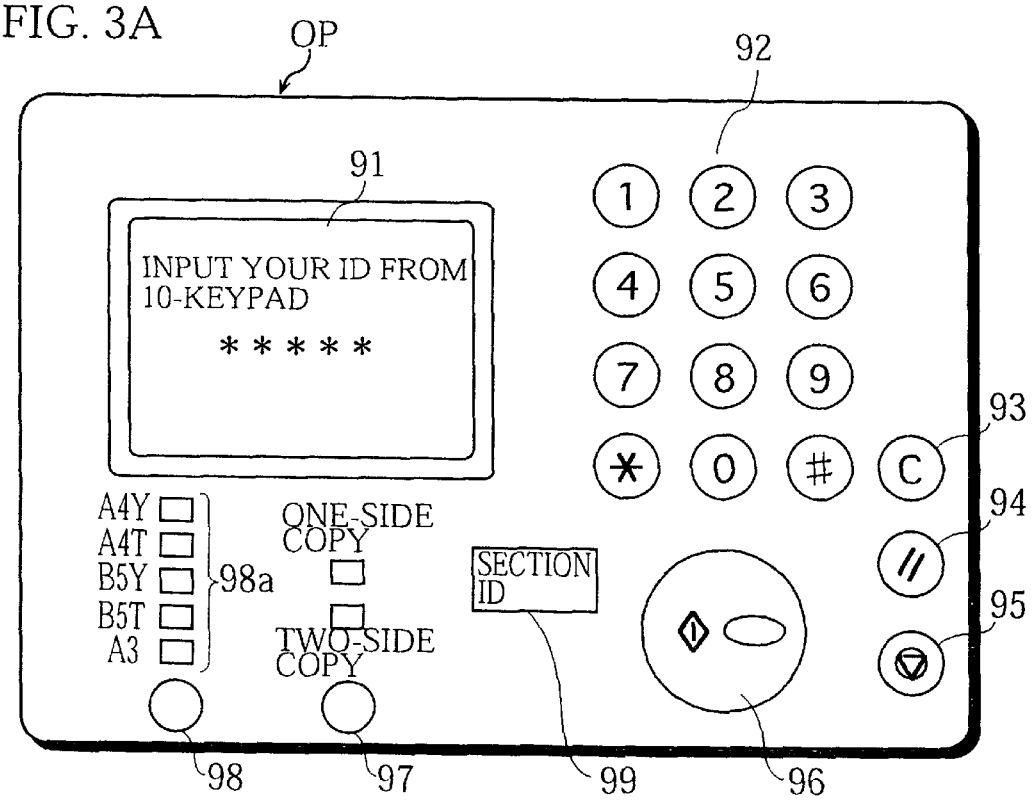
FIGS. 3A and 3B show the structure of an operation panel OP.
Figure 3B:
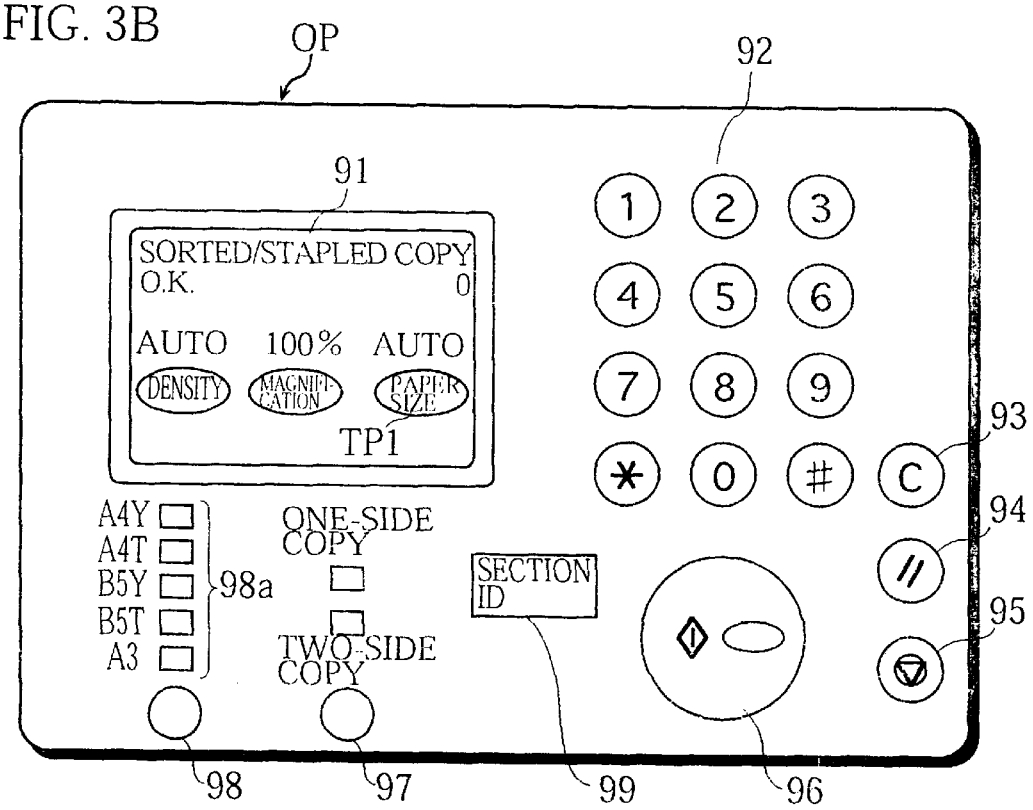

An operation panel OP shown in FIGS. 3A and 3B is also provided on the copying machine's main body 20 at its fore side of the upper portion. The operation panel OP includes a liquid crystal touch panel 91, a 10-keypad 92 for inputting magnification and the number of copies to be made, a clear key 93 for resetting the number of copies to the initial value "1", a panel reset key 94 for resetting copy mode and the like to initial state, a stop key 95 for stopping a copying operation, a start key 96 for starting a copying operation, a mode setting key 97 for setting a copy mode, a sheet size select key 98 for selecting the sheet size, a sheet size indicating unit 98*a* for indicating the selected sheet size, and a section ID setting key 99 for setting a section ID inputted from the 10-keypad 92.

The liquid crystal touch panel 91 is formed by laminating a touch panel for receiving key input on a liquid crystal display plate for displaying various guide messages and various keys used for the key input. In the initial state, the liquid crystal touch panel 91 displays the message "INPUT YOUR ID FROM 10-KEYPAD" as shown in FIG. 3A.

A user inputs the identification code (ID) of the section, to which he/she belongs, from the 10-keypad and then presses the section ID setting key 99. The identification codes of those sections that are allowed to use the copying machine are stored in the copying machine's main body 20 beforehand (hereinafter, these stored identification codes will be referred to as "registered section IDs"). If one of the registered section IDs is identical to the section identification code inputted from the operation panel OP (hereinafter referred to as "user section ID"), the user section ID data is transmitted to the host computer 1. The host computer 1 determines the number of copies to be made by the copying machine 2 from the maximum number of copies predetermined for the section and the total number of copies made so far, and then transmits permitted copy number data (hereinafter referred to as "limiting value data") to the copying machine 2 (the transmitter copying machine), which has transmitted the user section ID. The identification codes may be 4-digit numbers.

The copying machine 2 receives the limiting value data and sets the received limit number as the limit number of copies which the copying machine 2 is allowed to make. Copying operation is permitted within the limit number. Here, the liquid crystal touch panel 91 switches to the standard copying operation display together with the message "SORTED/STAPLED COPY O.K." as shown in FIG. 3B.

According to this display, a user can input various conditions, such as the number of copies to be made, magnification, sheet size, and density. By pressing the start key 96, an copying operation can be started under the conditions set by the user.

(2) Structure of the Control Unit

Figure 4:
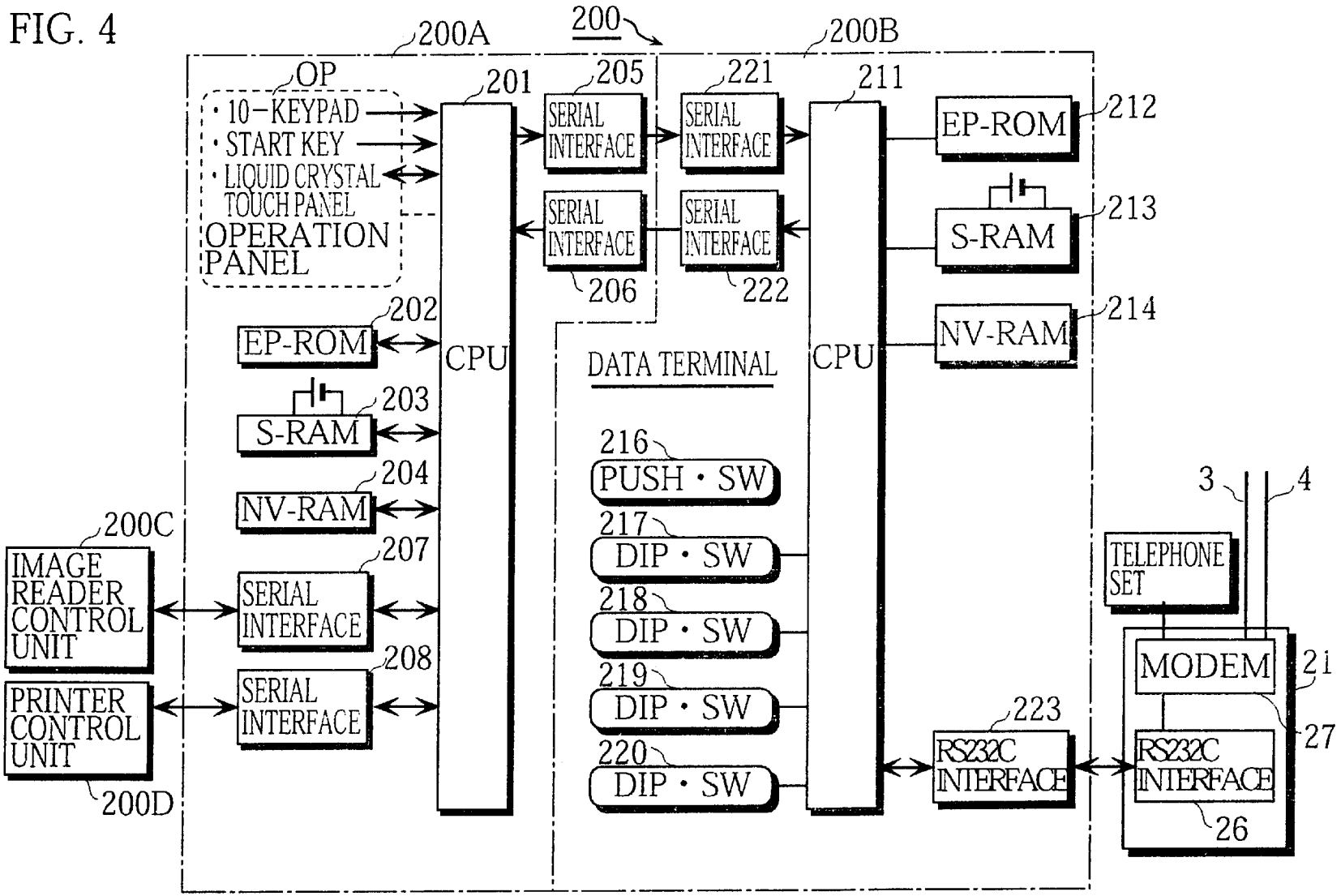
FIG. 4 is a block diagram showing the structure of the control unit 200 in a main body 20.

FIG. 4 is a block diagram showing the structure of the control unit 200 provided in the copying machine's main body 20. The control unit 200 includes an operation panel control unit 200A, a data terminal control unit 200B, an image reader control unit 200C, and a printer control unit 200D.

The communication between the operation panel control unit 200A and the data terminal control unit 200B is conducted via serial interfaces 205 and 221, and serial interfaces 206 and 222. The communication among the operation panel control unit 200A, the image reader control unit 200C, and the printer control unit 200D is conducted via serial interfaces 207 and 208, so that various kinds of data and commands can be transmitted to and from each control unit.

EP-ROMs 202 and 212 store basic programs essential to control operations. The CPUs 201 and 211 each reads out the program when necessary, and controls each unit according to the program. Battery-backed S-RAMs 203 and 213 store instructions from the user and the operation status of each unit, and send them to the CPUs 201 and 211, respectively.

The operation panel control unit 200A controls the display on the liquid crystal touch panel 91 of the operation panel OP, and transmits input data such as the user section ID to another control unit. The EP-ROM 202 stores a panel display program for switching display images on the liquid crystal touch panel 91, while an NV-RAM 204 stores data such as the initial state display mode and the standard display mode. The CPU 201 reads out the data, when necessary, to control the display on the liquid crystal touch panel 91.

Upon receipt of key input to start a copying operation from the operation panel OP, the panel control unit 200A receives information as to the number of copies and selected sheet size, and transmits the information to the data terminal control unit 200B via the serial interfaces 205 and 221.

The data terminal control unit 200B judges whether the user section ID inputted from the operation panel OP is identical to the registered section ID or not, and controls the communication with the host computer 1 and other copying machines via the modem unit 21. The modem unit 21 consisting of a modem portion 27 connected to the telephone line 3 and the private line 4, and an RS232C interface 26 connected to an RS232C interface 223 of the data terminal control unit 200B. Thus, the data terminal control unit 200B conducts the data communication between the present copying machine and another copying machine via the private line 4 as well as the data communication between the present copying machine and the host computer 1 via the telephone line 3.

The EP-ROM 212 stores one or more registered section IDs, a program for judging whether the user section ID inputted from the operation panel OP is identical to a registered section ID, and a program for communicating with the host computer 1 via the modem unit 21.

The NV-RAM 214 stores the identification code allocated to the present copying machine (hereinafter referred to as "machine ID") as well as the data of the machine IDs of the other copying machines and the telephone number of the host computer 1. The setting of the machine ID to the present copying machine is conducted as follows. A user inputs fixed values allocated to the dip switches 217 to 220 of the present copying machine, and presses a push switch 216, so that the CPU 211 reads the values from the dip switches 217 to 220 and stores them into the NV-RAM 214 as the machine ID of the present copying machine. Setting machine IDs for other copying machines and setting a telephone number of the host computer 1 are conducted in the same manner as described above.

The S-RAM 213 contains a number storage area for storing the number of copies and the number of paper jam occurrences, which are taken into consideration when performing maintenance. It also contains a work area which serves as a buffer for storing data transmitted to and from the host computer 1 and a temporary storage area for storing a flag.

Figure 5:
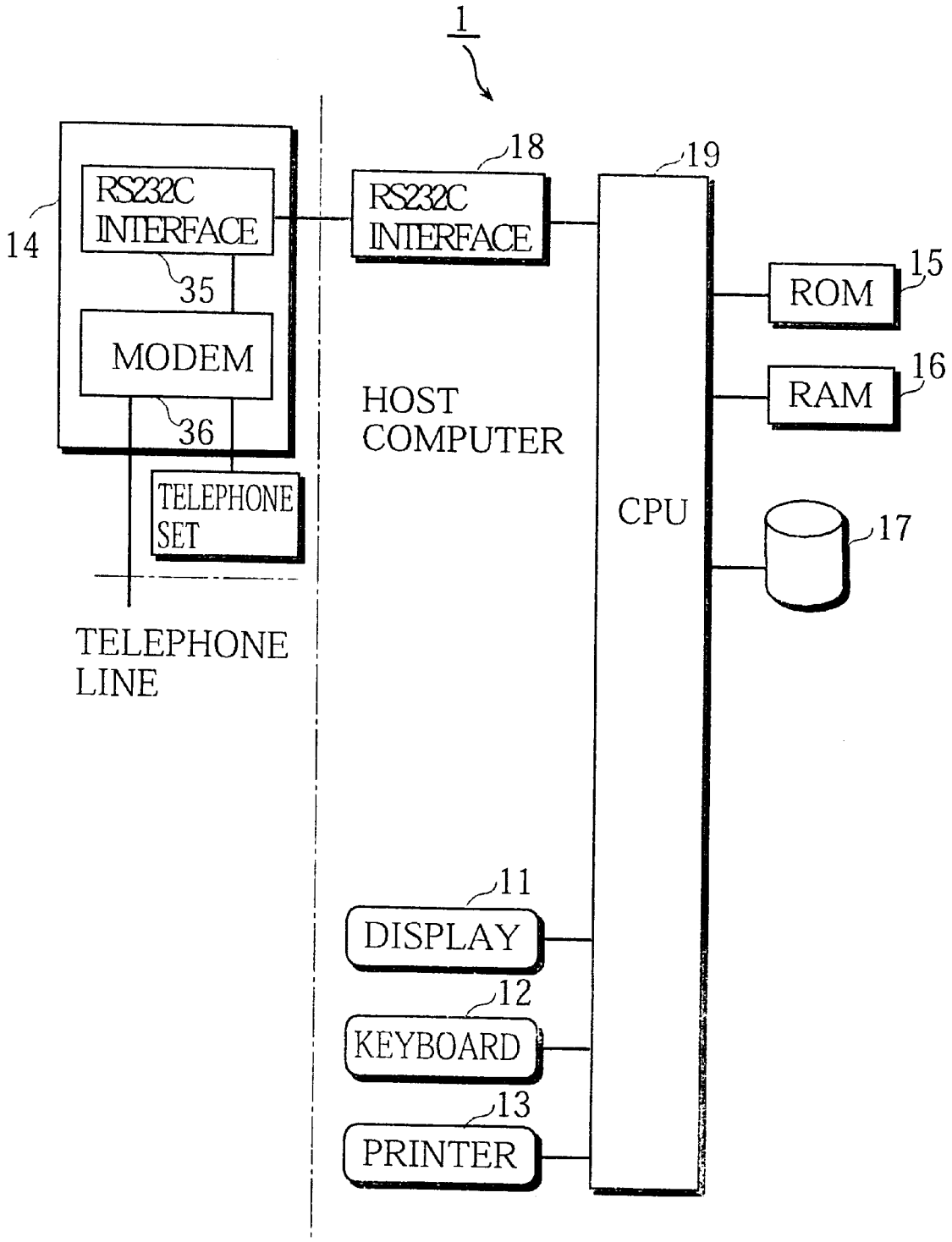
FIG. 5 is a block circuit diagram showing the structure of a host computer 1.

FIG. 5 is a block diagram showing the structure of the host computer 1. The host computer 1 shown in the figure is structured around a CPU 19, including a ROM 15 for storing a control program, a RAM 16 which serves as a buffer for storing transmission data and a temporary storage unit for storing a flag, a hard disk 17 for storing the maximum number of copies to be made and the total number of copies made in each section, and an RS232C interface 18 which serves as a communication interface.

The host computer 1 communicates with each of the copying machines 2-1 to 2-n via the modem unit 14 including an RS232C interface 35 and a modem portion 36. The host computer 1 also prints out data from the hard disk 17 and displays necessary information on the display 11. The clerks at the service center issue invoices and supervise maintenance of the copying machines 2-1 to 2-n according to the displayed information.

(3) Copy Number Control by the Copying Machine Supervisory Control System

Figure 6:
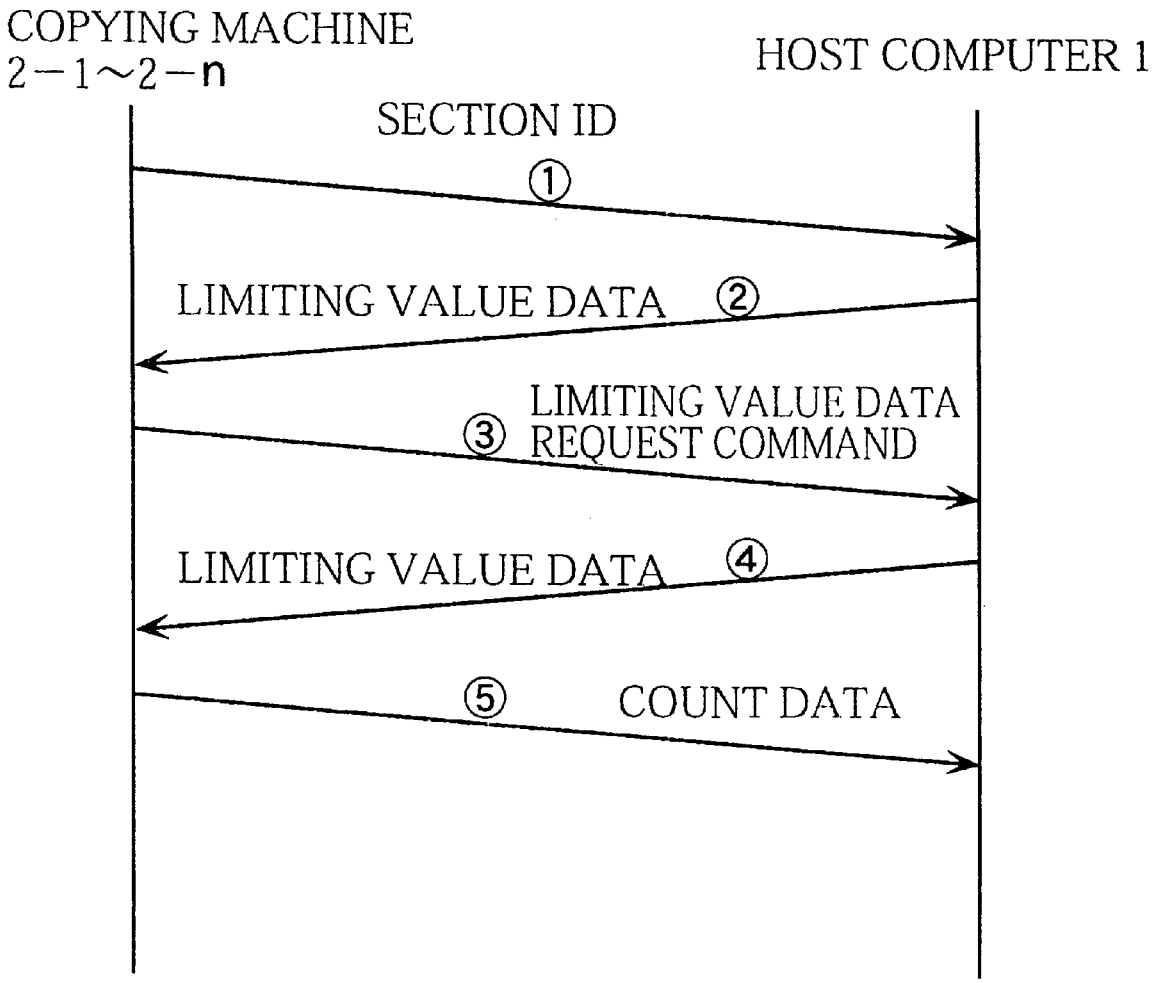
FIG. 6 is a sequence diagram showing the communication between the host computer and copying machines.

The following is an explanation of the copy number control operation of the copying machine supervisory control system, with reference to the sequence diagram of FIG. 6 showing the communication between a copying machine and the host computer.

When a user tries to use the copying machine 2-2, which happens to be the nearest from the user, he/she inputs his/her section identification code (user section ID) from the 10-keypad 92 (shown in FIG. 3A) on the operation panel OP, and then presses the section ID key 99. The inputted user section ID is transmitted to the CPU 211 (shown in FIG. 4) via the CPU 201. The CPU 211 searches the EP-ROM 212 for a registered section ID identical to the inputted user section ID. If there is a registered section ID identical to the inputted user section ID, the user is judged to belong to a section which is allowed to use the copying machine. The copying machine 2-2 then establishes a connection with the host computer 1, and the user section ID is transmitted to the host computer 1 via the modem unit 21 ((1) in FIG. 6).

The host computer 1 obtains the information as to the number of copies made by each copying machine under each section ID via the telephone line 3. Upon receipt of the user section ID, the host computer 1 subtracts the total number of copies made under the section ID from the maximum number of copies the section is allowed to make. The maximum number set for each section is stored in the hard disk 17 beforehand. The permitted copy number is thus determined for the user section ID, and a number within the range of the permitted copy number is transmitted as the limiting value data to the copying machine 2-2 via the telephone line 3 ((2) in FIG. 6).

More specifically, in the case where the maximum number of copies set for the user section ID is 10000 while the total number of copies made in the section so far is 7000, the permitted copy number should be 3000 (10000−7000). The CPU 211 transmits a number smaller than 3000 (100, for instance) as the limiting value data to the copying machine 2-2, so that the permitted copy number is temporarily set at 2900 (3000−100).

The host computer 1 does not assign the maximum permitted copy number for the section to the copying machine 2-2. Instead, the host computer 1 allocates a smaller number than the permitted copy number as the limiting value data to the copying machine 2-2, so that even when the same user section ID is received from a different copying machine during an copying operation by the copying machine 2-2, an copying operation can be possible by the different copying machine, to which limiting value data determined from a permitted copy number (2900) is temporarily allocated.

A number allocated as limiting value data is determined by a control program stored in the RAM 16, based on the permitted copy number, the average number of copies made in one operation in the section, and the number of times a limiting value data request command is received. In the meantime, a fixed number (100, for instance) may be invariably allocated to each copying machine, regardless of the above conditions.

The copying machine 2-2, which has received the limiting value data, sets the allocated number (100) indicated by the limiting value data as the copy limit number, and allows copying operations within that range. Here, the liquid crystal touch panel 91 on the operation panel OP switches to the display shown in FIG. 3B.

A user can input desired copy conditions from the operation panel OP and start a copying operation by pressing the start key 96. When making a large number of copies, the number of copies to be made might be larger than the copy limit number, 100. Because of this, a new limiting value data request command should be transmitted to the host computer 1 to determine a new permitted copy number when the total number of copies made so far reaches a predetermined number, for example, 80 ((3) in FIG. 6).

Upon receipt of the limiting value data request command, the host computer 1 again determines a permitted copy number from the maximum copy number for the user section ID stored in the hard disk 17 and the total number of copies made so far. If there remains a large enough number to be allocated, a number within that range (100, for instance) is transmitted again as limiting value data to the copying machine 2-2 ((4) in FIG. 6).

The copying machine 2-2 receives the limiting value data, updates its copy limit number data (200, for instance), and then advance to the next copying operation.

A limiting value data request command is automatically sent to the host computer 1, if the remaining number of allowable copies to be made by the present copying machine is large enough. Thus, a user can continue to use the copying machine without inputting his/her user section ID from the operation panel OP for the second time.

When the copying machine 2-2 has made a predetermined number of copies (180 copies, for instance), a limiting value data request command is transmitted again to the host computer 1 so as to request a new allocation of allowable copy number. On the other hand, if the copying machine 2-2 has finished its operation and the number of copies made so far has not reached the predetermined number of copies, the number of copies is transmitted as count data to the host computer 1, and the copying machine 2-2 and the host computer 1 are then disconnected ((5) in FIG. 6).

Based on the count data, the host computer 1 updates the data of the total number of copies made under the user section ID stored in the hard disk 17. A permitted copy number is determined from the above updated data.

Whether the copying machine 2-2 has finished copying is judged by the CPU 211 in the case where a predetermined period of time has passed without any key input from the operation panel OP. Even if the predetermined period of time has not passed, the copying operation can be judged to be terminated when a new user section ID is inputted.

If the host computer 1 has received a user section ID or a limiting value data request command, but no longer has a capacity left for the section, the number "0" is transmitted as the limiting value data to the copying machine 2-2. Upon receipt of the allocated number "0", the copying machine 2-2 determines that no more copying operations are allowed under the user section ID. If the limiting value data "0" is the first limiting value data received since the user section ID has been inputted, the copying machine 2-2 prohibits copying under the user section ID, while if the limiting value data "0" is the second or later received data since the input of the user section ID, the copying machine 2-2 prohibits copying when the number of copies made under the user section ID reaches the predetermined copy limit number.

In this manner, the copying machine 2-2 receives from the host computer 1 a number which is smaller than the largest possible number allocated to the user section ID. Copying is permitted within the number, and thus the number of copies made by the section never surpasses the upper limit number.

(4) Operations of the Control Units

The following is a detailed description of the operations of the control units to control the number of copies by the copying machine supervisory control system, referring to the flowcharts shown in the drawings.

(4-1) Control Operations for the Copying Machines 2-1 to 2-n

Figure 7:
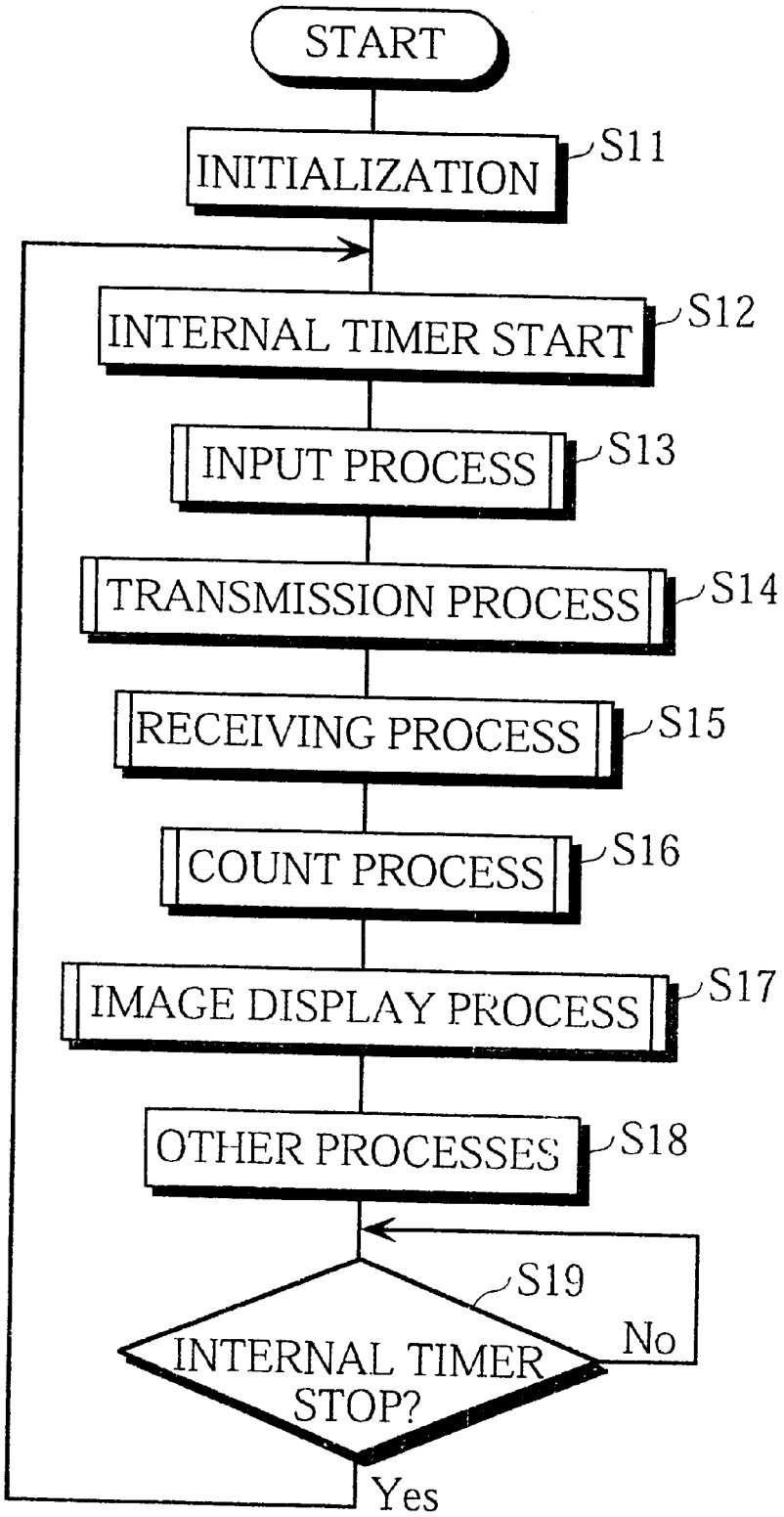
FIG. 7 is a flowchart showing the main routine executed by the CPU 201 and CPU 211 of each copying machine.

FIG. 7 is a flowchart showing the main routine of the control operation performed by the CPU 201 and the CPU 211 of each of the copying machines 2-1 to 2-n.

Upon switching on the copying machine, the CPU 211 of the data terminal control unit 200B initializes the work area of the S-RAM 213 and others (step S11). The internal timer is then started (step S12), and it controls the period of time in which the main routine is performed (step S19).

The main routine includes an input process in which various kinds of key input are received from the operation panel OP (step S13); a transmission process in which user section IDs and the limiting value data request command are transmitted to the host computer 1 (step S14), a receiving process in which limiting value data are received from the host computer 1 (step S15), a count process in which the number of copies made in the user's section (step S16), an image display process in which various messages are displayed on the operation panel OP (step S17), and other processes, such as executing an copying instruction sent to the image reader control unit 200C or the printer control unit 200D (step S18).

Each of the processes S13 to S17 is described below in detail.

Figure 8:
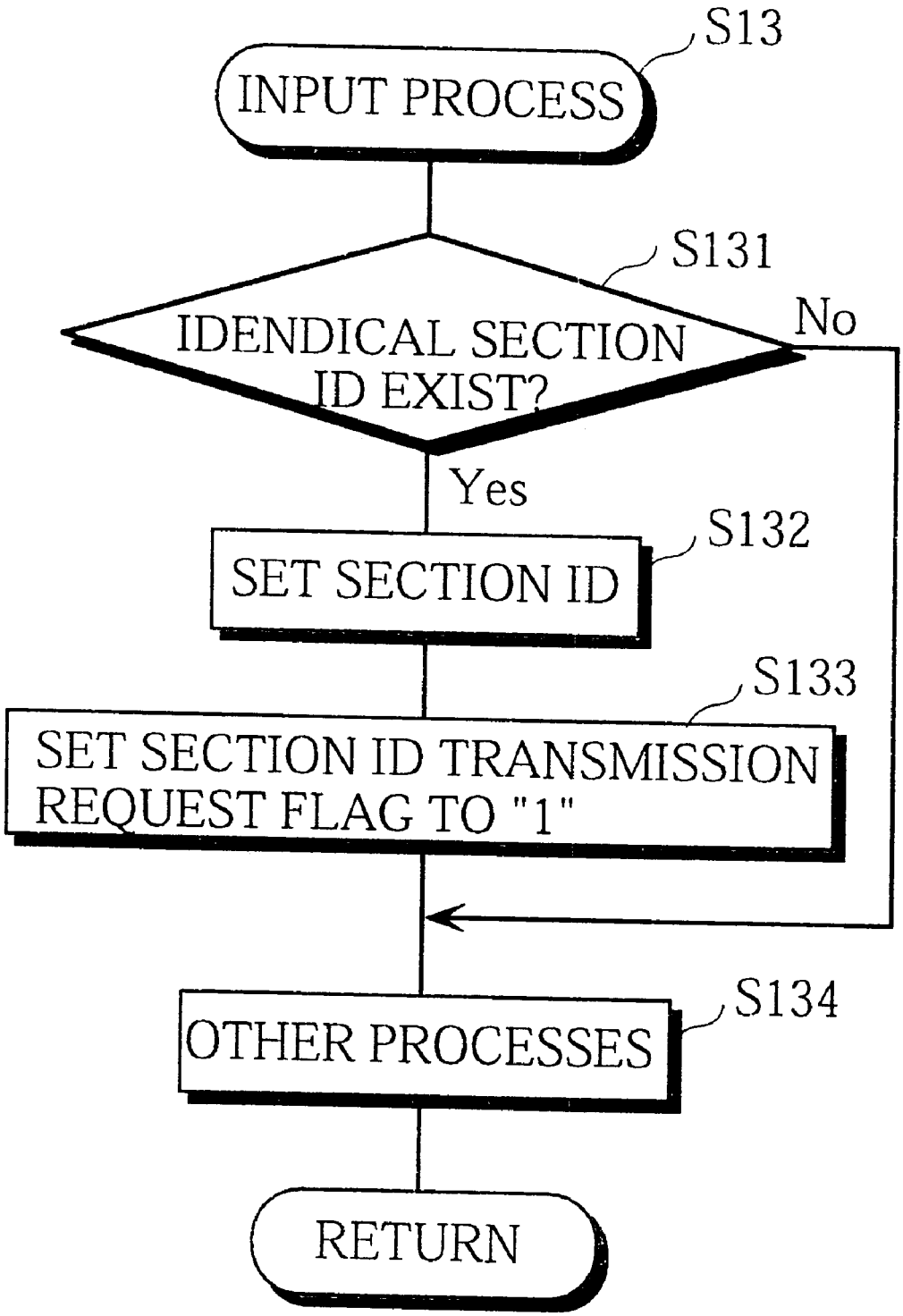
FIG. 8 is a flowchart showing the inputting subroutine of the main routine of FIG. 7.

FIG. 8 is a flowchart showing the input processing subroutine in step S13. When a user inputs his/her section ID from the operation panel OP, the CPU 201 informs the CPU 211 of the user section ID. The CPU 211 then searches the EP-ROM 212 for the informed user section ID (step S131), and if there is a registered section ID identical to the user section ID, the CPU 211 sets the user section ID in a section ID storage unit provided in the S-RAM 213 (step S132).

In order to transmit the section ID to the host computer 1, a section ID transmission request flag in the S-RAM 213 is set to "1" (step S133). Other processes, such as informing the CPU 201 that the user section ID and a registered section ID are identical, are performed (step S134). This subroutine is then terminated.

If there is no registered section ID identical to the user section ID in step S131, steps S132 and S133 are skipped. Instead, other processes, such as informing the CPU 201 that no registered section ID is identical to the user section ID, are performed (step S134). This subroutine is then terminated.

Figure 9:
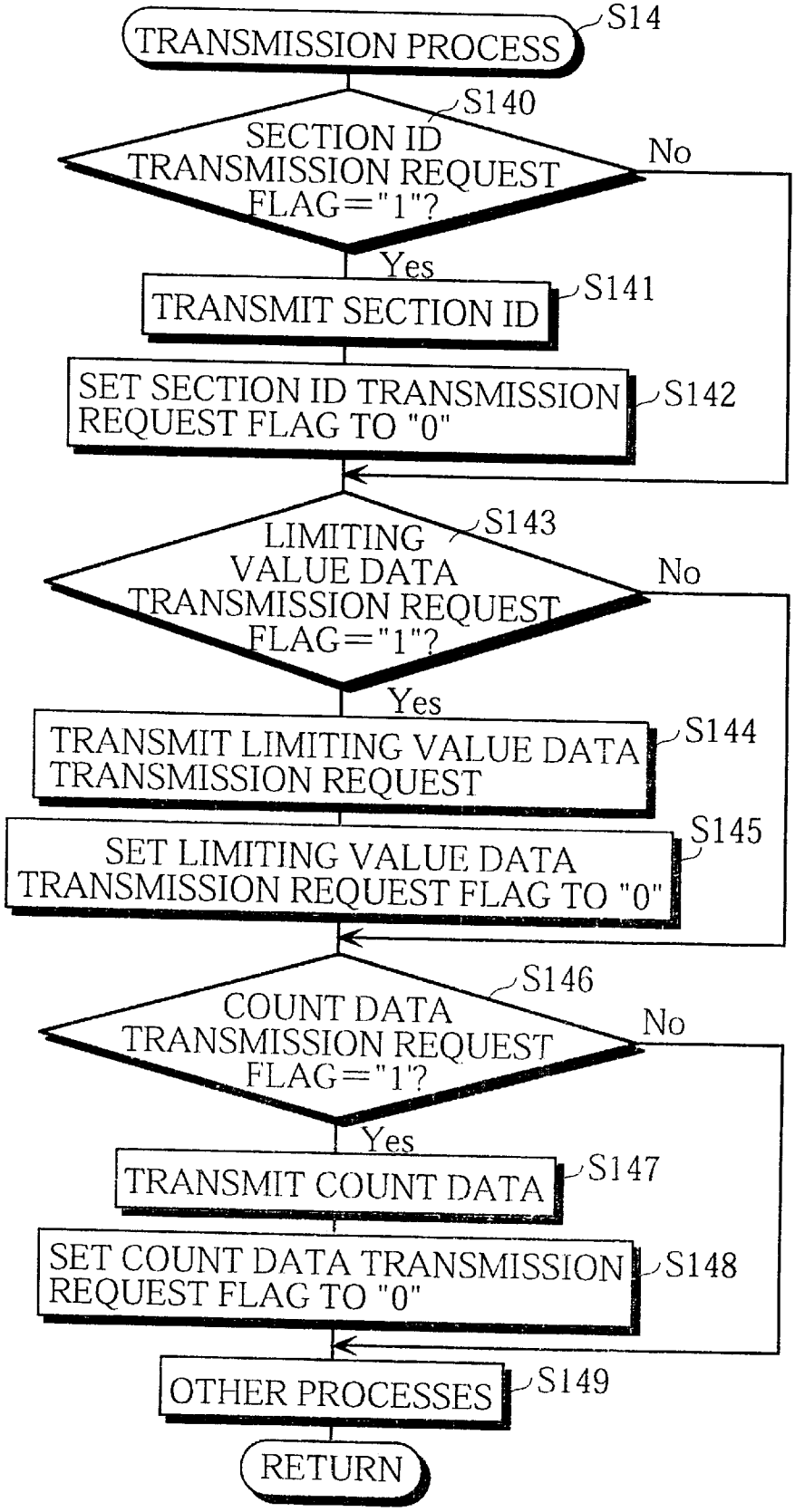
FIG. 9 is a flowchart showing the section ID transmission subroutine of the main routine of FIG. 7.

FIG. 9 is a flowchart showing the transmission process subroutine in step S14.

Firstly, the CPU 211 judges whether the section ID transmission request flag is "1" (step S140). If it is, the CPU 211 transmits the user section ID data stored in the section ID storage unit to the host computer 1 via the telephone line 3 (step S141), and resets the section ID transmission request flag (step S142). If the section ID transmission flag is not "1" in step S140, the CPU 211 skips steps S141 and S142, and advances to step S143.

In step S143, the CPU 211 judges whether the limiting value data transmission request flag in the S-RAM 213 is "1". The limiting value data transmission request flag is set to "1", when the copying machine requests the host computer 1 to allocate a new limit number during a copying operation because the number of copies made has reached the limit number received from the host computer 1 (see step S165 in FIG. 11).

If the limiting value data transmission request flag is "1", the CPU 211 issues a limiting value data transmission request command and transmits it to the host computer 1 (transmission of a limiting value data transmission request: step S144). The CPU 211 then resets the limiting value data transmission request flag (step S145).

If the limiting value data transmission request flag is not "1" in step S143, the CPU 211 skips steps S144 and S145, and advances to step S146.

In step S146, the CPU 211 judges whether a count data transmission request flag in the S-RAM 213 is "1". The count data transmission request flag is set when a copying operation is finished under the user section ID. If the count data transmission request flag is "1", the CPU 211 transmits the number of copies made under the user section ID as count data to the host computer 1 (step S147). The CPU 211 then resets the count data transmission request flag to "0" (step S148). After that, the CPU 211 advances to step S149, where other processes are performed, and then returns to the main routine.

If the count data transmission request flag is not "1" in step S146, the CPU 211 skips steps S147 and S148. Instead, the CPU 211 advances to step S149, where other processes are performed, and then returns to the main routine.

Figure 10:
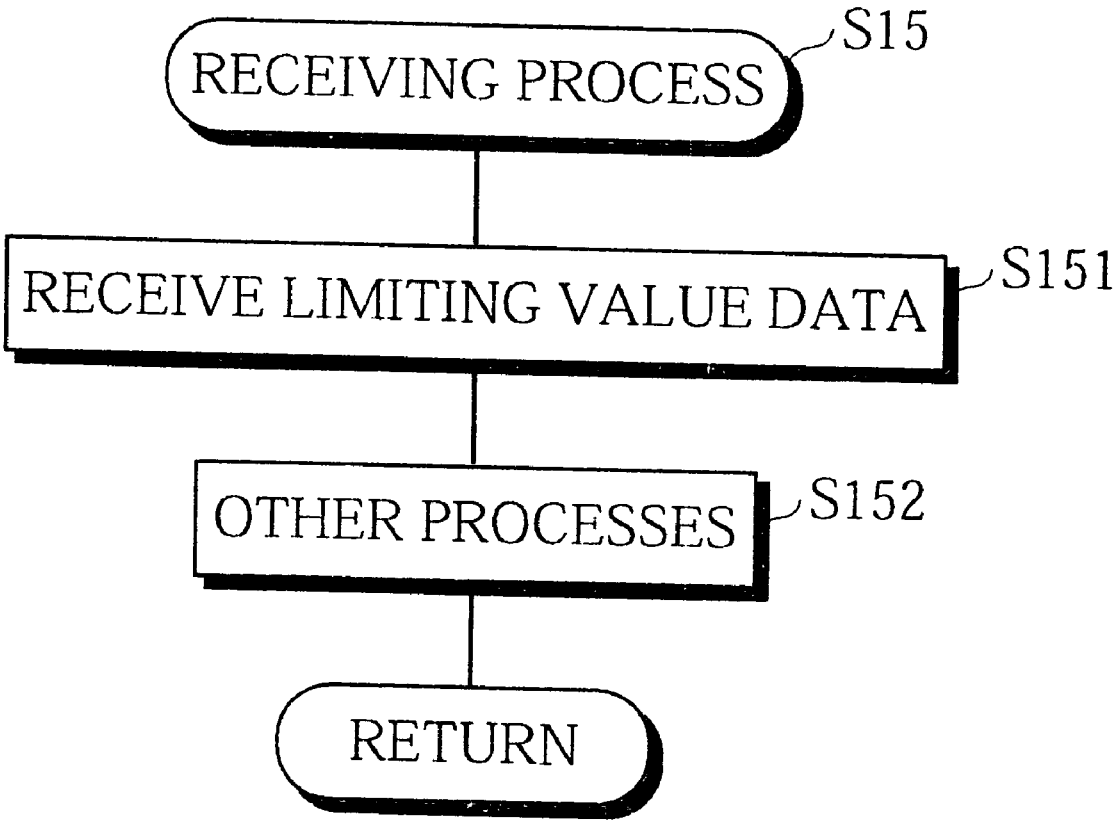
FIG. 10 is a flowchart showing the receiving subroutine of the main routine of FIG. 7.

FIG. 10 is a flowchart showing the receiving process subroutine in step S15.

In this subroutine, the CPU 211 receives limiting value data from the host computer 1 via the telephone line 3 (step S151). The limiting value indicated by the limiting value data is stored in the S-RAM 213 as the limit number of copies to be allowed for the section having the inputted user section ID. When the CPU 211 receives limiting value data for the second time or later, the new limiting value is added to the already stored limiting value, and the addition result is set as a new limit number.

Other processes are performed (step S152), and this subroutine is then terminated.

Figure 11:
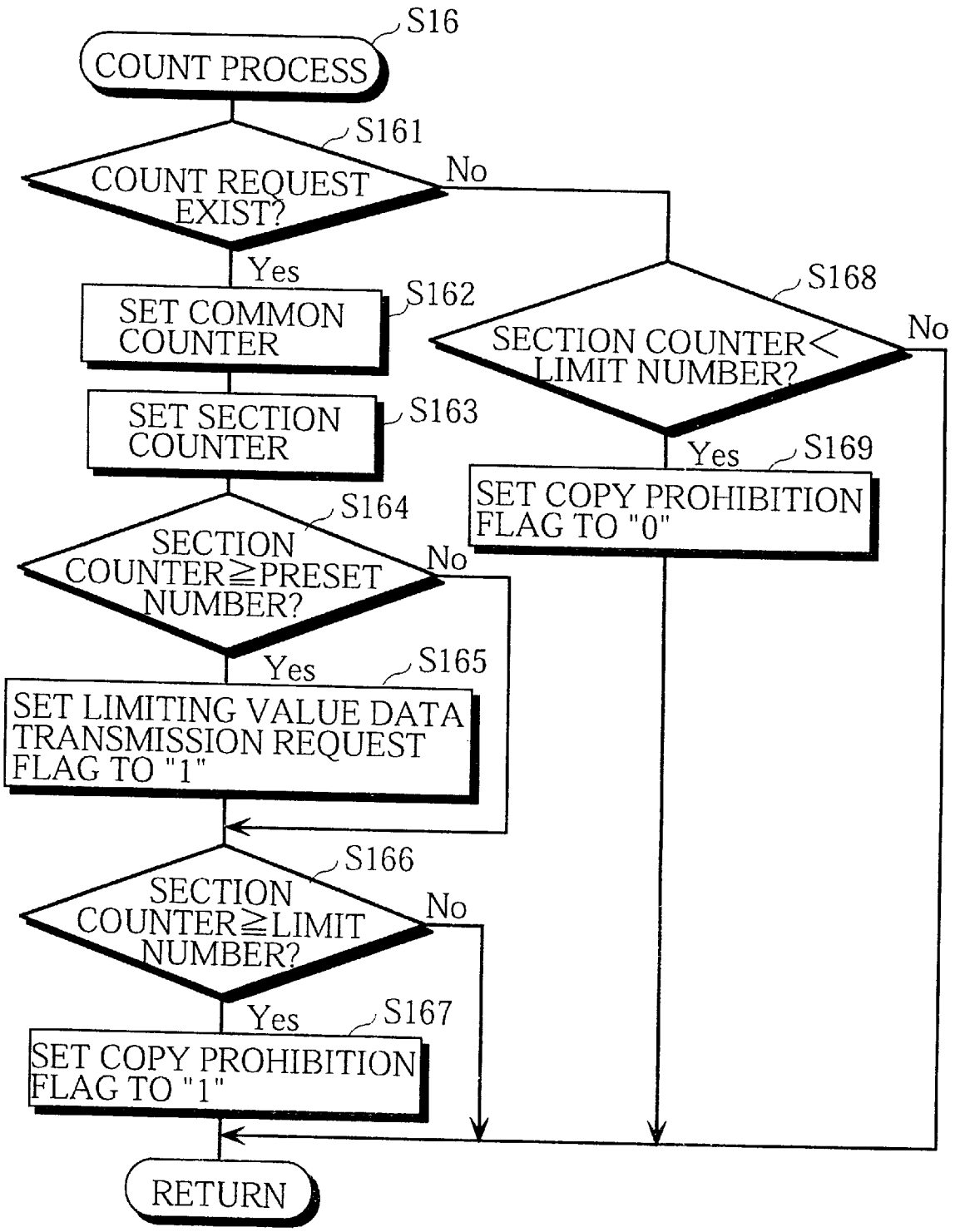
FIG. 11 is a flowchart showing the counting subroutine of the main routine of FIG. 7.

FIG. 11 is a flowchart showing the count process subroutine in step S16. In this subroutine, the CPU 211 judges whether a count request has been transmitted from the printer control unit 200D (step S161). The count request is transmitted from the printer control unit 200D every time an image is formed on a copying sheet. The CPU 211 counts the number of count requests, and sets it as the number of copies in the normal counter (common counter setting: step S162). The CPU 211 also sets the number of copies in one of the section counters provided in S-RAM 213, which corresponds to the section indicated by the inputted user section ID (section counter setting: step S163). By doing so, the total number of copies made in all the sections is set in the common counter, while the number of copies made in each section is set in a section counter.

The CPU 211 then judges whether the number of copies made under the inputted user section ID set in the section counter is not smaller than a predetermined number (step S164). Such a predetermined number represents approximately 80 percent of the value of limiting value data transmitted from the host computer 1. If the number of copies made in the section is equal to or larger than the predetermined number, the CPU 211 sets the limiting value data transmission request flag to "1" (step S165). If the number of copies made in the section is smaller than the predetermined number, the CPU 211 skips step S165, and advances to step S166.

In step S166, the CPU 211 judges whether the value of the section counter is not smaller than a limit number set in the present copying machine based on the limiting value data (step S166). If it is equal to or larger than the limit number, the CPU 211 sets a copy prohibition flag to "1" so as to prohibit copying (step S167). If it is smaller than the limit number, the CPU 211 skips step S167, and returns to the main routine, because more copies can be made.

If there is no count request transmitted from the printer control unit 200D in step S161, the CPU 211 judges whether the number of copies made under the inputted user section ID stored in the section counter is smaller than the limit number (step S168). For instance, as the limit number increases having received a new copy number allocation for the user section ID, the number of copies made under the user section ID on the section counter is smaller than the limit number, the copy prohibition flag is reset to "0" so as to permit a copying operation (step S169). If the number of copies is not smaller than the limit number, the CPU 211 returns to the main routine without resetting the copy prohibition flag so as to keep to prohibit copying by the copying machine.

As described above, each of the copying machines 2-1 to 2-n determines whether to prohibit a copying operation in accordance with the relationship between the limiting value data received from the host computer 1 and the number of copies made by each copying machine. A copying operation of each copying machine is permitted until the number of copies made under the user section ID indicated on the section counter reaches the limit number. When the number of copies made under the user section ID reaches the limit number, a copying operation of the copying machine is prohibited.

Figure 12:
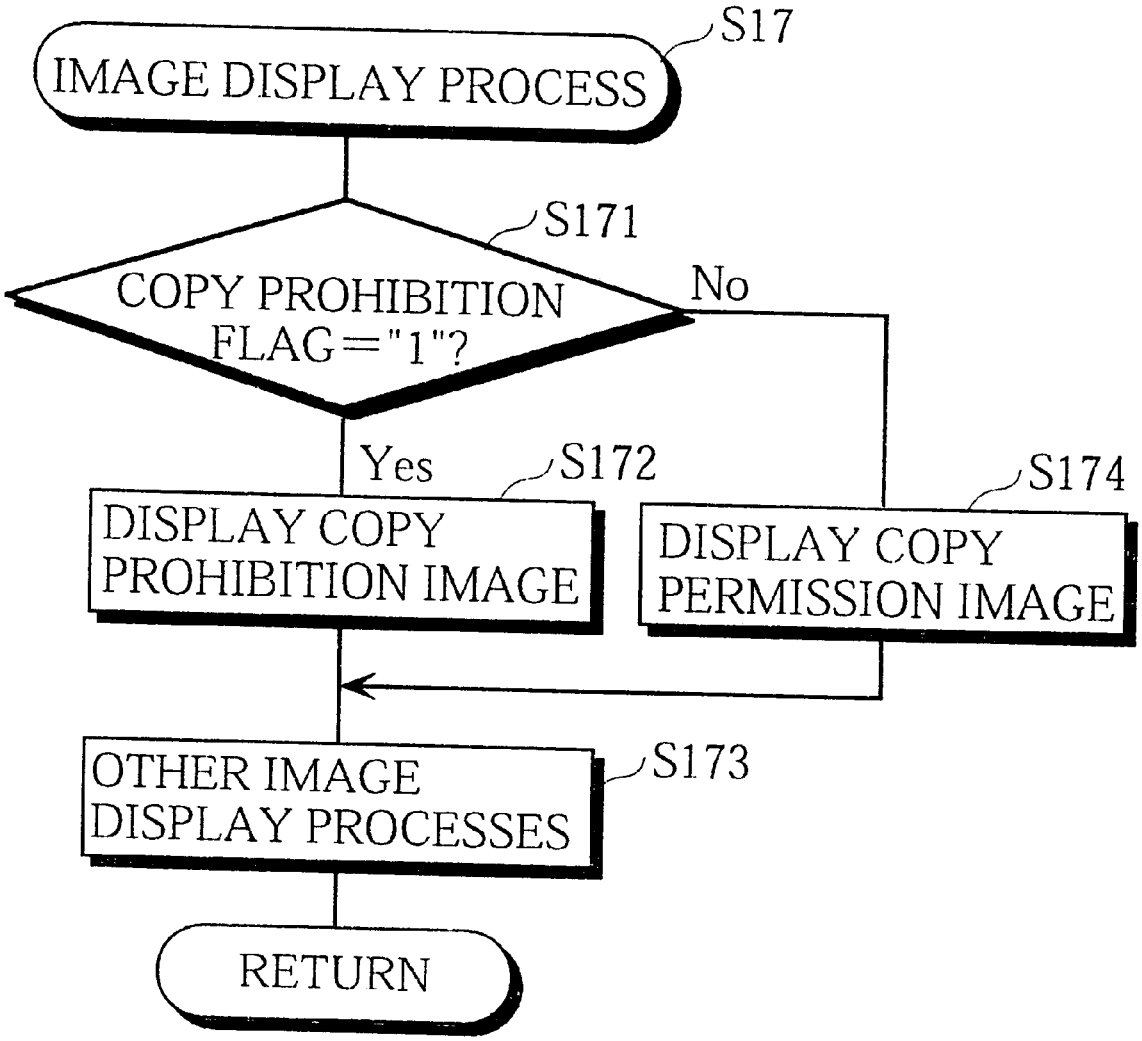
FIG. 12 is a flowchart showing the image display subroutine of the main routine of FIG. 7.

FIG. 12 is a flowchart showing the image display process subroutine in step S17.

In this subroutine, the CPU 211 judges whether the copy prohibition flag is "1" (step S171), and informs the CPU 201 of the result. If the copy prohibition flag is "1", the CPU 201 orders to display a copy prohibition image (step S172). More specifically, the CPU 201 orders the liquid crystal touch panel 91 to display the message "Over the Limit. No More Copies Permitted".

If the copy prohibition flag is not "1" in step S171, the CPU 201 controls the liquid crystal touch panel 91 so as to switch a copy permission image shown in FIG. 3B (step S174). Following step S172 or S174, the CPU 201 then performs other processes like returning the display image to the initial section supervisory image shown in FIG. 3A after a predetermined period of time has passed without new input (step S173), and it then returns to the main routine.

(4-2) Control Operation of the Host Computer 1

The following is an explanation of the control operation of the host computer 1.

Figure 13:
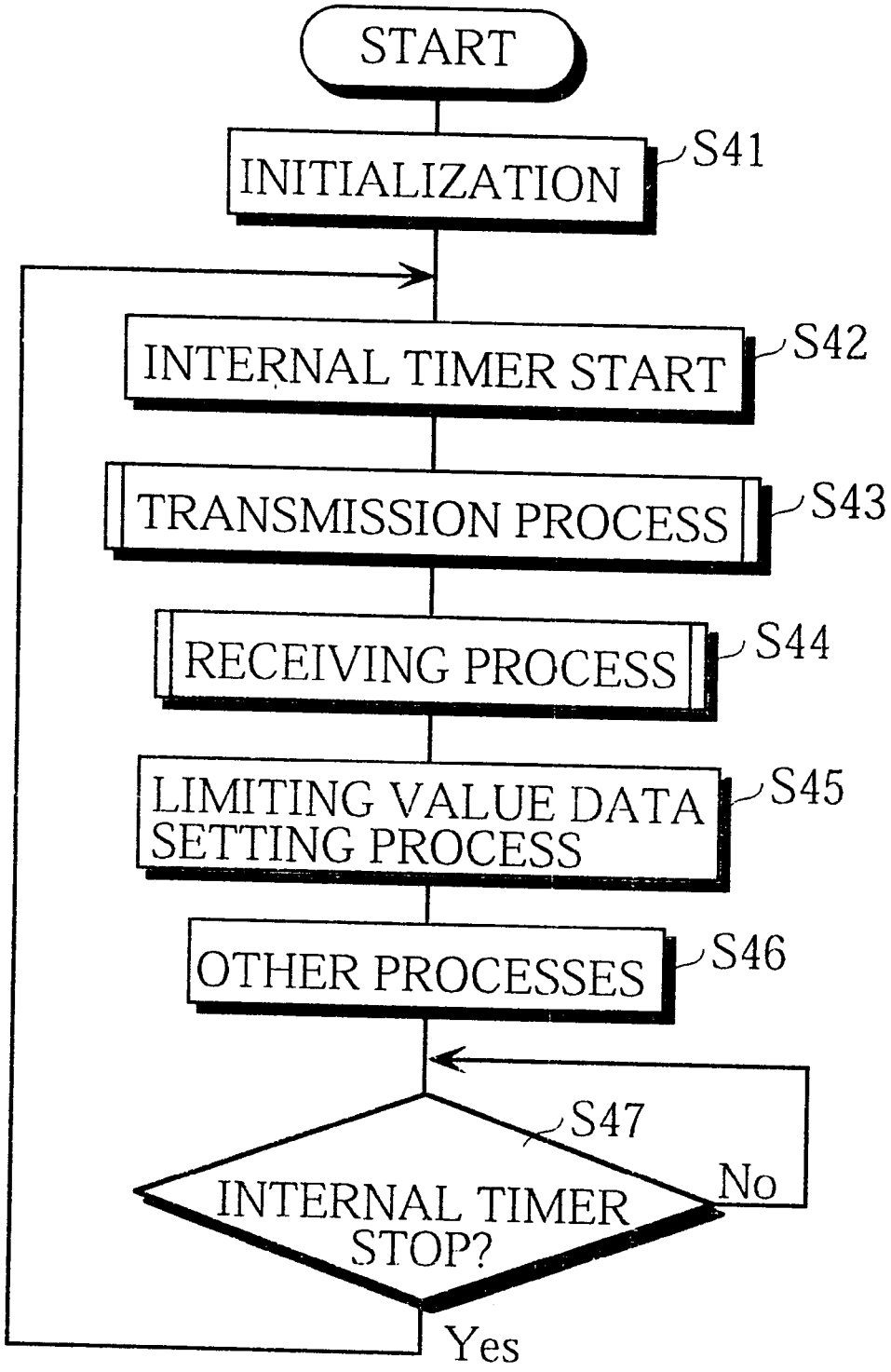
FIG. 13 is a flowchart showing the main routine executed by the CPU 19 of the host computer 1.

FIG. 13 is a flowchart showing the main routine of the CPU 19 (shown in FIG. 5) of the host computer 1. Upon switching on the host computer, the CPU 19 initializes the internal registers, the RAM 16, and any others (step S41), and starts the internal timer so as to control the timing of the main routine (steps S42 and S47).

In step S43, a transmission process is performed for transmitting data to the copying machines 2-1 to 2-n. In step S44, a receiving process is performed for receiving the data and commands from the copying machines 2-1 to 2-n. In step S45, a limiting value data setting process is performed for setting the above-mentioned limiting value data. In step S46, other processes, such as ordering maintenance of the copying machines 2-1 to 2-n, are performed.

Figure 14:
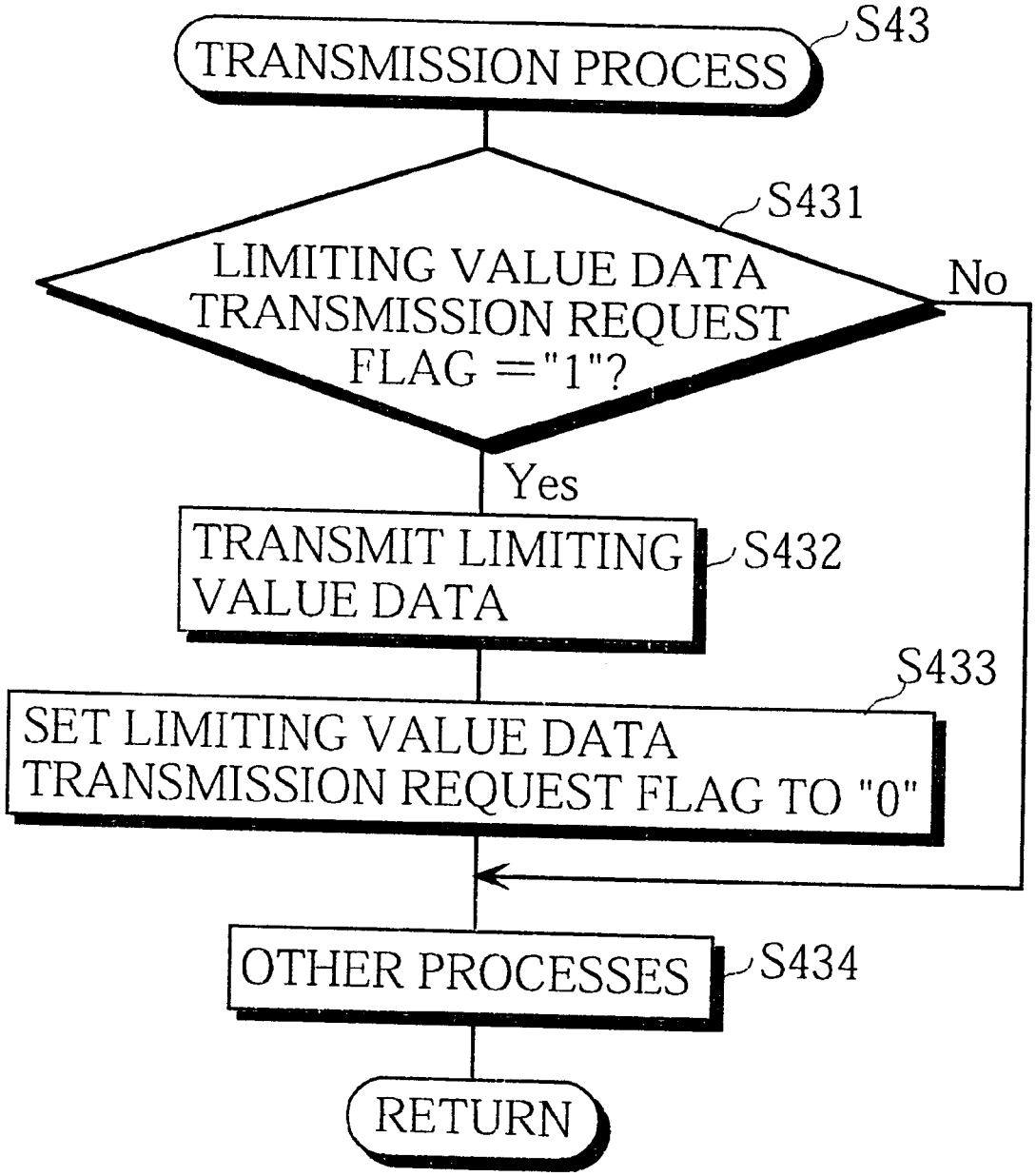
FIG. 14 is a flowchart showing the transmission subroutine of the main routine of FIG. 13.

FIG. 14 is a flowchart showing the transmission process subroutine in step S43.

Firstly, the CPU 19 judges whether a limiting value data transmission request flag in the RAM 16 is "1" (step S431). The limiting value data transmission request flag is set in accordance with transmission from the copying machines 2-1 to 2-n, as described later (see step S442 of FIG. 15). If the limiting value data transmission request flag is "1", the CPU 19 transmits limiting value data to a transmitter copying machine 2, which has transmitted the user section ID or a limiting value data request command (step S432). The CPU 19 then resets the limiting value data transmission request flag to "0" (step S433).

If the limiting value data transmission request flag is not "1", the CPU 19 skips steps S432 and S433, and performs other processes, such as transmitting invoices to each section (step S434). The CPU 19 then returns to the main routine.

Figure 15:
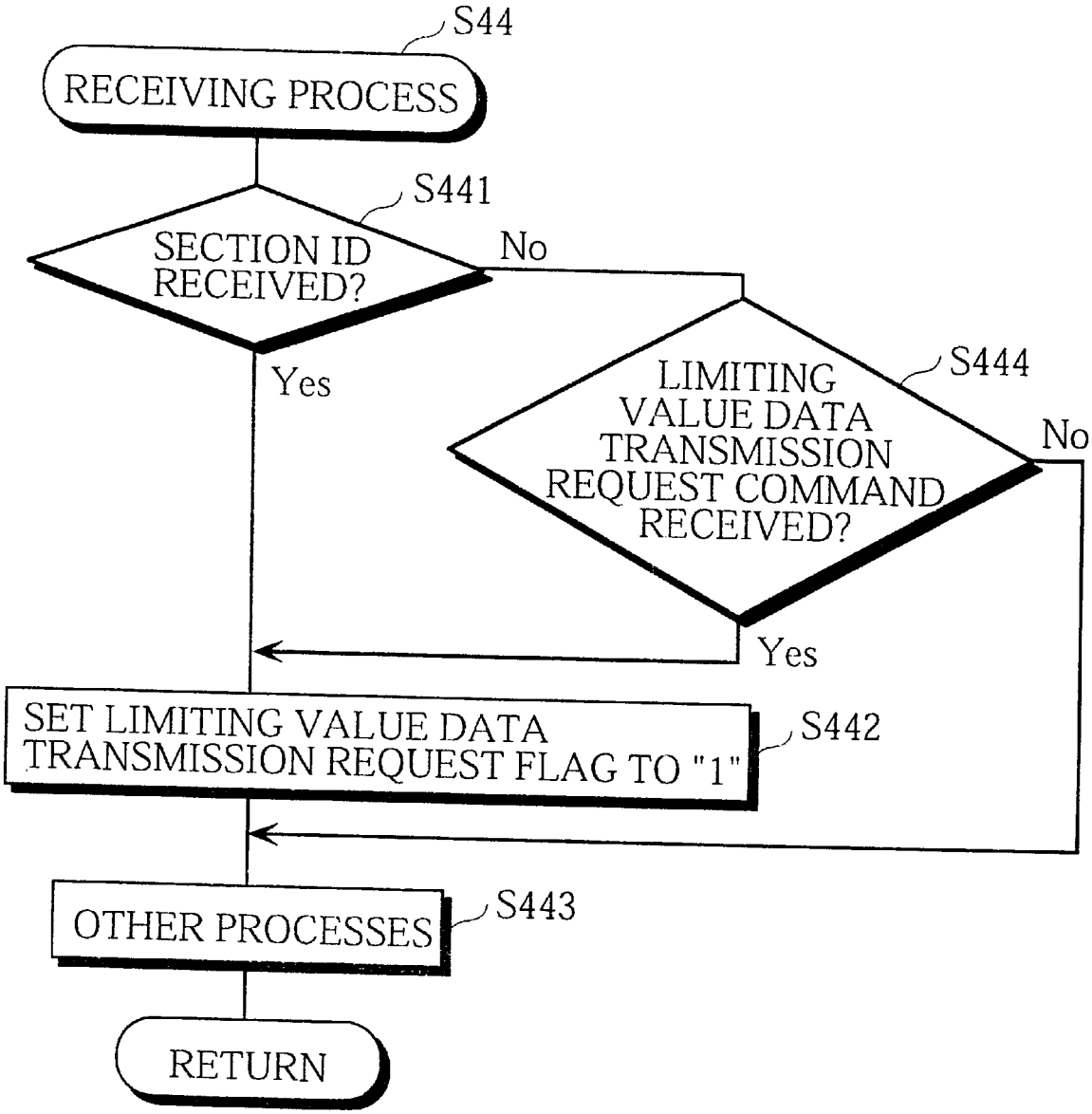
FIG. 15 is a flowchart showing the receiving subroutine of the main routine of FIG. 13.

FIG. 15 shows the receiving process subroutine in step S44. In this subroutine, the CPU 19 judges if there is a user section ID received from any of the copying machines 2-1 to 2-n by looking into the contents of the received data in the receiving buffer provided in the RAM 16 (step S441). If there is a received user section ID, the CPU 19 sets a limiting value data transmission request flag in the RAM 16 to "1" (step S442).

If there is no received user section ID in step S441, the CPU 19 looks into the received data in the receiving buffer to judge whether a limiting value data transmission request command has been received (step S444). If there is a received limiting value data transmission request command in the receiving buffer, the CPU 19 advances to step S442, and sets the limiting value data transmission request flag to "1". If there is no received limiting value data transmission request command, the CPU 19 advances to step S443 to perform other processes, and then returns to the main routine.

As described so far, if there is a user section ID or a limiting value data transmission request command received from any of the copying machines 2-1 to 2-n, the host computer 1 sets a predetermined number, which is within the remaining number of times the user section ID is permitted to make a copy, as the limiting value data, and transmits it to the transmitter copying machine, which has transmitted a user section ID or a limiting value data transmission request command.

(5) Modifications

Although the present invention has been described by way of the above embodiment, it should be noted that the present invention is not limited to the embodiment and that various modification can be made as follows.

(5-1) In the case where the host computer 1 has received identical user section IDs from a plurality of copying machines at once, a number is set within the largest possible number that can be allocated for the user section ID. This number is divided equally or at a ratio taking into consideration the number of copies made by each copying machine so far, and the quotient is allocated to each copying machine so that relevant limiting value data can be set for each copying machine. Thus, copying can be performed smoothly without exceeding the upper limit number of copies.

(5-2) In the above embodiment, each copying machine receives limiting value data from the host computer 1, and transmits the number of copies as count data to the host computer 1 each time a copying operation is finished ((5) in FIG. 6). The number of copies made by each section, however, may not be necessarily transmitted to the host computer 1 each time a copying operation is finished. The number of copies may be stored in a memory of the copying machine itself together with the remaining number of times allocated as limiting value data for the section. The next time the copying machine is used by the section, another copy number allocation may be requested to the host computer 1 by transmitting the user section ID or a limiting value data transmission request command when the number of copies made by the section has reached the remaining number stored in the memory.

Upon charging each section for copying expenses, the host computer 1 may calculate it from the number of times already allocated as the limiting value data (in this case, the remaining number of copies which have not yet been made is paid for in advance). The host computer 1 may calculate the copying expenses by inquiring the number of copies made by each section stored from each copying machine 2 on a regular basis over the network, and adding up the number of copies made by each section.

When controlling the number of copies according to this modification of the embodiment, it is not necessary to transmit a user section ID to the host computer 1 every time one is inputted from the operation panel OP. Thus, the communication costs can be saved in a network system using a public telephone line.

(5-3) When transmitting a user section ID or a limiting value data request command, a copying machine ID may also be transmitted from a copying machine 2 to the host computer 1. By doing so, even if, after the copying machine 2 has called the host computer 1 on a telephone line so as to transmit the user section ID, the host computer 1 and the copying machine 2 are disconnected before limiting value data are transmitted from the host computer 1, the copying machine 2 can transmit the limiting value data via the telephone line by looking up the telephone number stored in the hard disk 17 referring to the copying machine ID and calling the copying machine 2 on the line.

Even when this does not happen, the host computer 1 can grasp the number of copies made by each copying machine 2 from each copying machine ID, so that maintenance can be performed properly.

(5-4) The present invention is applied to a copying machine supervisory control system in the above embodiment, but it may also be applied to a supervisory control system for another type of image forming apparatus, such as a printer.

(5-5) A plurality of copying machines are connected to the host computer 1 in the above embodiment, but the present invention may be applied to a supervisory control system in which only one image forming apparatus is connected to the host computer. In such case, the limit number allocated to a received user section ID may be the largest possible number that can be allocated to the user section ID, i.e., the number calculated by subtracting the total number of copies made under the user section ID from the upper limit number of copies which are allowed to make under the user section ID.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus supervisory system comprising:

an image forming apparatus having an input unit for inputting an identification code and a transmission unit for transmitting the identification code; and a control device connected to the image forming apparatus, having a reception unit for receiving the identification code, and a transmission unit for transmitting to the image forming apparatus a signal for informing the image forming apparatus of a permitted number of times an image can be formed in response to receipt of the identification code, wherein upon receipt of the signal from the control device, the image forming apparatus permits forming an image the permitted number of times.

2. An image forming apparatus supervisory system according to claim 1, wherein the control device further includes:

a storage unit for storing a maximum number of times an image can be formed and a total number of times an image has been formed under each of a plurality of identification codes; and a setting unit for setting, when the identification code is received from the image forming apparatus, the permitted number within the range of a number which is determined by subtracting the total number of times from the maximum number of times under the received identification code.

3. An image forming apparatus supervisory system according to claim 1, wherein the image forming apparatus prohibits image forming operations when the actual number of times an image has been formed reaches the permitted number.

4. An image forming apparatus supervisory system according to claim 1, wherein the control device is connected to the image forming apparatus via a telephone line.

5. An image forming apparatus supervisory system according to claim 1, wherein the control device is a computer.

6. An image forming apparatus supervisory system comprising:

a plurality of image forming apparatuses each having an input unit for inputting an identification code and a transmission unit for transmitting the identification code; and a control device connected to the plurality of image forming apparatuses, having a reception unit for receiving the identification code, and a transmission unit for transmitting, in response to receipt of the identification code, a signal for informing one of the plurality of image forming apparatuses, which has transmitted the identification code, of a permitted number of times an image can be formed, wherein upon receipt of the signal from the control device, the image forming apparatus permits forming an image the permitted number of times.

7. An image forming apparatus supervisory system according to claim 6, wherein the control device further includes:

a storage unit for storing a maximum number of times an image can be formed and a total number of times an image has been formed under each of a plurality of identification codes; and a setting unit for setting, when the identification code is received from one of the plurality of image forming apparatuses, the permitted number within the range of a number which is determined by subtracting the total number of times from the maximum number of times under the received identification code.

8. An image forming apparatus supervisory system according to claim 6, wherein said each image forming apparatus prohibits image forming operations when the actual number of times an image has been formed reaches the permitted number.

9. An image forming apparatus supervisory system according to claim 6, wherein the control device is connected to the plurality of image forming apparatuses on a telephone network.

10. An image forming apparatus supervisory system according to claim 6, wherein the control device is a computer.

11. A method for supervising the number of times an image is formed by an image forming apparatus using a system including the image forming apparatus and a control device connected to each other, comprising the steps of:

(1) inputting an identification code into the image forming apparatus;

(2) transmitting the inputted identification code from the image forming apparatus to the control device;

(3) transmitting from the control device to the image forming apparatus a signal for informing the image forming apparatus of a permitted number of times an image can be formed in response to receipt of the identification code by the control device; and (4) permitting the image forming apparatus to form an image the permitted number of times, upon receipt of the signal by the image forming apparatus.

12. A method for supervising the number of times an image is formed by an image forming apparatus using a system including the image forming apparatus and a control device connected to each other according to claim 11, wherein the control device includes a storage unit for storing a maximum number of times an image can be formed and a total number of times an image has been formed under each of a plurality of identification codes, and upon receipt of an identification code from the image forming apparatus in step (3), sets the permitted number before transmitting, the permitted number being within the range of a number which is determined by subtracting the total number of times from the maximum number of times under the received identification code.

13. A method for supervising the number of times an image is formed by an image forming apparatus using a system including the image forming apparatus and a control device connected to each other according to claim 11, further comprising the step of (5) prohibiting image forming operations by the image forming apparatus, when the actual number of times an image has been formed reaches the permitted number.

14. A method for supervising the number of times an image is formed by an image forming apparatus using a system including the image forming apparatus and a control device connected to each other according to claim 11, further comprising the steps of:

(6) transmitting a signal from the image forming apparatus to the control device for requesting re-allocation of a permitted number of times, when the actual number of times an image has been formed reaches a predetermined number which is smaller than the permitted number of times;

(7) setting a newly permitted number of times by the control device according to the re-allocation request signal transmitted from the image forming apparatus, and then transmitting a signal from the control device to the image forming apparatus for informing the image forming apparatus of the newly permitted number of times; and (8) according to the signal transmitted from the control device in step (7), permitting the image forming apparatus to form an image the number of times determined by adding the newly permitted number to the originally permitted number.

15. A method for supervising the number of times an image is formed by an image forming apparatus using a system including the image forming apparatus and a control device connected to each other according to claim 11, wherein the control device is connected to the image forming apparatus via a telephone line.

16. A method for supervising the number of times an image is formed by an image forming apparatus using a system including the image forming apparatus and a control device connected to each other according to claim 11, wherein the control device is a computer.

17. A control device for controlling an image forming apparatus comprising:

a reception unit for receiving an identification code transmitted from the image forming apparatus; and a transmission unit for transmitting to the image forming apparatus a signal for informing the image forming apparatus of a permitted number of times an image can be formed in response to receipt of the identification code.

18. A control device according to claim 17, further comprising:

a storage unit for storing a maximum number of times an image can be formed and a total number of times an image has been formed under each of a plurality of identification codes; and a setting unit for setting, when the identification code is received from the image forming apparaus, the permitted number within the range of a number which is determined by subtracting the total number of times from the maximum number of times under the received identification code.

19. A control device according to claim 17, wherein said control device is connected to the image forming apparauts via a telephone line.

20. A control device according to claim 17, wherein said control device comprises a computer.

* * * * *